US006411570B1

(12) United States Patent
Smith

(10) Patent No.: US 6,411,570 B1
(45) Date of Patent: Jun. 25, 2002

(54) PROCRASTINATOR'S WATCH

(76) Inventor: Mildred B. Smith, 3905 Ernjo Rd., Jacksonville, FL (US) 32209

( * ) Notice: Subject to any disclaimer, the term of this patent is extended or adjusted under 35 U.S.C. 154(b) by 0 days.

(21) Appl. No.: 09/800,993

(22) Filed: Mar. 8, 2001

(51) Int. Cl.[7] ..... G04B 37/00
(52) U.S. Cl. ..... 368/73; 368/281
(58) Field of Search ..... 368/281, 282, 368/71–73, 223–229

(56) References Cited

U.S. PATENT DOCUMENTS 5,355,352 A * 10/1994 Kobayashi et al. ..... 368/10
5,471,438 A * 11/1995 Kobayashi et al. ..... 368/10

* cited by examiner

*Primary Examiner*—Bernard Roskoski
(74) *Attorney, Agent, or Firm*—Arthur G. Yeager

(57) ABSTRACT

This invention relates to a reminder watch to be worn on the body of a forgetful person. The watch has a digital display of the date of the day, the time of day, and the name of the weekday; a knob for setting the time and a knob for starting and stopping the time to function as a stop-watch; and the remaining parts of the watch include a small speaker to play sounds such as the voice of a parent and an alarm to indicate that time has run out, a battery to provide power for operating the watch and its functions, and a computer chip specifically designed to announce commands relating to the daily activities of the wearer of the watch, who may be a child. The watch may be worn as a wrist watch fastened to a waist belt, hung around the neck, upper arm, or shoulder, carried in a pocket, or carried in any other fashion so as to be near enough to be heard.

3 Claims, 1 Drawing Sheet

PROCRASTINATOR'S WATCH

CROSS-REFERENCE TO RELATED APPLICATIONS

Not Applicable

STATEMENT REGARDING FEDERALLY SPONSORED RESEARCH

Not Applicable

BACKGROUND OF THE INVENTION (1) Field of the Invention

This invention relates to a watch to be worn by a person to tell the time of day, and more particularly, a watch to be worn by a person who needs to be reminded of special times to do special tasks which otherwise might be forgotten. This invention is particularly suitable for children.

(2) Description of the Related Art

There is no known prior art especially related to this invention. Of course, there are wrist watches and pocket watches to be carried by persons who need to be aware of the time as he moves through his daily tasks, but none of this prior art provides more than the date and time and perhaps an alarm to be set for any selected time the watch owner wishes to select.

BRIEF SUMMARY OF THE INVENTION

The present invention is a watch (which may be worn on the wrist; hung around the neck,upper arm, or shoulder; carried in a pocket; or carried in any other way convenient for the wearer) and set to produce one or more alarms at selected times to remind the wearer to undertake a task at that time. The watch is especially useful in the training of children or forgetful persons to perform certain tasks at specified times of the day. The watch has a clear display of the date, time of day in minutes and seconds, and day of the week; and it has three or more alarms that are set to sound off at given times specified by a computer chip that is programmed to announce the time and perhaps include an appropriate brief message along with the time. It may be that in some instances,the three alarms will merely be two repeats of the first message so as to be sure that the first message is obeyed. In other instances the three alarms will provide three separate warnings of three successive tasks to be performed. In the case of children the first alarm might be an awakening call, the second alarm might be a reminder to brush ones teeth and the third alarm might be a call to breakfast. Obviously, a different chip might be used on the weekend to get the children to awaken and prepare for a day that does not include going to school. Chips can be prepared to accomodate any given set of times and dates and activities.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in conjunction with the accompanying drawings in which:

DETAILED DESCRIPTION OF THE INVENTION

This invention relates to a watch to be worn on the person of one who needs to be reminded of the current time so as to start certain prescribed activities on time and continue in accordance with a regular schedule for the day. This invention is particularly directed to use by children who have little regard for maintaining a time schedule and need to be taught to pay attention to the current time so as to be ready to leave one activity and move on to the next one on the schedule at the proper time. The watch of this invention is depicted in the attached drawings and the reader's attention is directed thereto for a better understanding of the invention.

Figure 1:
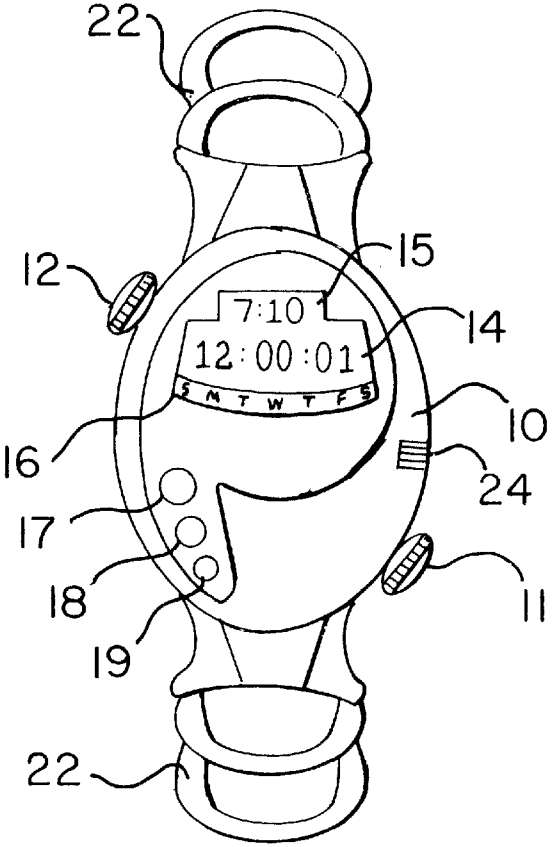
FIG. 1 is a top plan view of the face of the watch of this invention.
Figure 2:
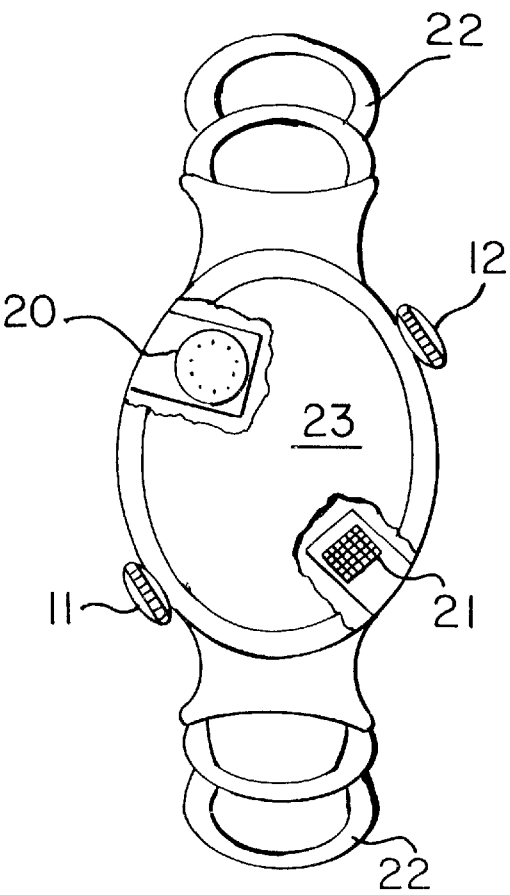
FIG. 2 is a bottom plan view of the back of the watch with two portion of the back cover broken away to show the battery and the computer chip which furnish the power to operate the watch and the director of the functions provided by the watch.

FIGS. 1 and 2 show the two faces of the watch; FIG. 1 shows the front face and FIG. 2 shows the back face. The watch case 10 and the band attaching ring are not fashioned in any particular shape important to this invention. The watch case is generally round or oval and designed to hold the working parts of the watch in a compact case that is not too large to be worn comfortably by the wearer. The shape may be round, square, or polygonal as desired, and the thickness of the case may be thin or thick within the limits of being large enough to make the reading of the numbers and letters easy and small enough to make the bulk of the watch an insignificant weight to add to the wearer's body.

The principal feature on the watch front face is a digital time display 14 including the date 15 the minutes and seconds of the current time 14 and an indication of the day of the week 16. Knob 12 is connected to the timer display 14 so as to set the correct day, weekday, and current time by proper manipulation of knob 12. There also is a small speaker 24 to relay. any messages and/or alarm sounds produced by the watch. The remaining features on the watch front face are three alarm buttons 17, 18, and 19. These buttons are employed to turn off an alarm activated by the computer chip 21 which may be designed to initiate any of several types of activities, as is well known today. The wearer merely needs to touch whichever button relates to the alarm. If the alarm is coming from the first of the alarms the wearer touches button 17 to turn off the alarm. If this is the second alarm the wearer will touch button 18 to turn it off, and so on for the third alarm controlled by button 19.

Knob 11 is a stop-watch controller allowing one to set it for any desired amount of elapsed time that can be started by movement of the stem of knob 11 and stopped by the reverse movement of the stem.

The power and functions of the watch are controlled by a battery 20 housed in a covered recess available from the back face 23 of the watch. The functions of the watch are controlled by a computer chip 21 housed in a second covered recess. The chip can be fashioned to fit whatever the owner requires in the field of memory jogging. For example, the principal purpose of Chip No. 1 may be merely to arouse someone from sleep and get him started in the day. The first alarm may be to awaken the subject and tell him it is time to rise and shine, the second alarm may merely be a follow up to be sure the subject gets up, and the third alarm may be to tell him breakfast is ready and awaiting him. The same chip could then tell him it was time to catch a school bus and the next alarm could announce the time to be arriving at his seat in school, and so through the day using the alarms over and over as time passed during the day and to include appropriate brief voice messages. Another chip might be inserted in the watch in place of Chip No. 1 for days when the child wearer was not in school and it could remind the child to go home to lunch or to dinner.

While the invention has been described with respect to certain specific embodiments it will be appreciated that many modifications and changes may be made by those skilled in the art without departing from the spirit of the invention. It is intended therefore, by the appended claims to cover all such modifications and changes as fall the true spirit and scope of the invention.

What is claimed as new and what it is desired to secure by Letters Patent of the United States of America is:

1. A watch showing on its face a digital indication of the date, the current time in minutes and seconds, and the day of the week; and in addition a minute speaker and one or more push buttons projecting slightly upwardly from the face of the watch; the watch including two thumb-operated knurled knobs, one of which controls the setting of the date, time, and day of the week and the other of which controls the time indicator to start and stop as a stop-watch; said watch including two covered recesses on its back, one of which houses a battery for operating the functions of the watch, and the other of which houses a computer chip which provides voice directions at selected times during the day and sounds alarms at selected times, the alarms being silenced by pressure applied to said push buttons.

2. The watch of claim 1 which is a wrist watch.

3. The watch of claim 1 having three push buttons connected so as to silence all voice output from the watch when the button is pushed.

* * * * *